United States Patent [19]

Barbe

[11] Patent Number: 4,719,927

[45] Date of Patent: Jan. 19, 1988

[54] METHOD AND APPARATUS FOR SEGREGATING ROD-SHAPED ARTICLES FROM CONVEYORS IN FILTER TIPPING AND LIKE MACHINES

[75] Inventor: Karl-Heinz Barbe, Hamburg, Fed. Rep. of Germany

[73] Assignee: Körber AG, Hamburg, Fed. Rep. of Germany

[21] Appl. No.: 833,531

[22] Filed: Feb. 25, 1986

[30] Foreign Application Priority Data

Mar. 8, 1985 [DE] Fed. Rep. of Germany ..... 3508242

[51] Int. Cl.[4] ..... A24C 5/47

[52] U.S. Cl. ..... 131/94; 131/95

[58] Field of Search ..... 131/93, 94, 95, 96

[56] References Cited

U.S. PATENT DOCUMENTS

| | | | |
|---|---|---|---|
| 3,583,546 | 6/1971 | Koop | 131/94 |
| 3,730,811 | 5/1973 | Wendt | 156/367 |
| 3,889,240 | 6/1975 | Buchegger | 131/94 |
| 3,962,957 | 6/1976 | Hinzman | 131/280 |
| 4,237,907 | 12/1980 | Pawelko et al. | 131/94 |
| 4,368,743 | 1/1983 | Barbe et al. | 131/94 |
| 4,445,519 | 5/1984 | Hinz | 131/94 |

FOREIGN PATENT DOCUMENTS

| | | | |
|---|---|---|---|
| 1911102 | 5/1969 | Fed. Rep. of Germany | 131/94 |
| 2842834 | 4/1980 | Fed. Rep. of Germany | 131/94 |

*Primary Examiner*—V. Millin

*Attorney, Agent, or Firm*—Peter K. Kontler

[57] ABSTRACT

A filter tipping machine wherein a drum-shaped conveyor whose peripheral flutes deliver groups of coaxial rod-shaped components of filter cigarettes and partially applied adhesive-coated uniting bands to a draping station where the uniting bands are rolled around the respective groups of components has a rolling block which is movable toward and away from the peripheral surface of the conveyor so as to roll the oncoming components ahead of the draping station to the extent which is necessary to dislodge the components and the uniting bands from the respective flutes. This enables the dislodged components to leave the conveyor by gravity and/or under the action of centrifugal force when it becomes necessary to clean the peripheral surface of the conveyor and/or other parts of the machine at the draping station. The block has a relatively short rolling surface which cooperates with the peripheral surface of the conveyor to expel the oncoming components from the respective flutes but does not cause or permit the dislodged components to reach the nearest flute. The flow of air into suction ports which communicate with the flutes is throttled during travel of such flutes past and beyond the block so as to prevent the separated components from returning into contact with the peripheral surface of the conveyor.

23 Claims, 2 Drawing Figures

METHOD AND APPARATUS FOR SEGREGATING ROD-SHAPED ARTICLES FROM CONVEYORS IN FILTER TIPPING AND LIKE MACHINES

BACKGROUND OF THE INVENTION

The present invention relates to a method of and to an apparatus for manipulating articles of the tobacco processing industry, especially for manipulating articles which include one or more rod-like components and an adhesive-coated sheet-like component. More particularly, the invention relates to improvements in a method of and in an apparatus for effecting removal of articles of the tobacco processing industry from a predetermined path wherein the artices are advanced at predetermined locations, e.g., toward a processing station where two or more components of each article are connected to each other by draping the adhesive-coated sheet-like component around two or more coaxial rod-like components.

It is well known to advance partially assembled or about-to-be assembled articles of the tobacco processing industry along a predetermined path in such a way that the articles are equidistant from each other during travel toward a processing station. By way of example, many presently used filter tipping machines employ rotary drum-shaped conveyors with fluted peripheral surfaces for the transport of groups of coaxial rod-shaped components (e.g., a filter plug of double unit length between two plain cigarettes of unit length) and partially attached adhesive-coated uniting bands toward a draping or rolling station where the uniting bands of successive articles are convoluted around the respective groups to form filter cigarettes of unit length or multiple unit length. Typical examples of such filter tipping machines are those known as MAX and MAX S (both manufactured by the assignee of the present application).

If the operation of one or more units in a filter tipping machine is unsatisfactory (e.g., if a conveyor which transports components of articles in the just outlined manner is contaminated with adhesive paste so that it can no longer predictably advance the components to the draping station, or if the transfer station or stations between such conveyor and the conveyor or conveyors which deliver components of the articles are clogged with articles or with components of articles), it is necessary to interrupt the advancement of additional untreated or unprocessed articles toward the defective unit or units as well as to remove the components which are already on their way toward the affected unit or units. Since each and every interruption of the operation of a modern high-speed filter tipping or like machine entails enormous losses in output (for example, a modern cigarette maker can turn out up to and in excess of 8000 plain cigarettes per minute), it is desirable and advantageous to eliminate minor causes of malfunction while the machine continues to run so as to eliminate those losses which are due to the making of unsatisfactory articles during starting and/or during deceleration of the machine from its rated speed. Thus, at the very least, the elimination of a minor defect while the machine continues to run reduces the total losses in output to those arising during the interval which is actually needed to eliminate the cause or causes of malfunction.

If the conveyor on which the rod-like components of articles in a filter tipping machine are draped into so-called uniting bands (i.e., into adhesive-coated sheet-like components) requires cleaning, the articles which are in the process of advancing toward the draping station must be diverted from the conveyor so that they cannot reach the draping station while the rolling surface of such conveyor is being relieved of remnants of adhesive and/or other impurities. Commonly owned U.S. Pat. No. 4,237,907 to Pawelko et al. discloses a filter tipping machine wherein rod-shaped articles which advance with the peripheral surface of a drum-shaped conveyor and are held thereon by suction can be released by sealing the suction generating device from the suction ports of the conveyor and/or by admitting blasts of compressed air to thus positively expel the components of articles from the flutes at the periphery of the conveyor. A drawback of such proposal is that, as a rule, the suction generating device is disconnected from all suction ports of the drum-shaped conveyor so that the rod-shaped and other components which were held in the respective flutes of the conveyor are free to leave the conveyor (e.g., under the action of gravity and/or under the action of centrifugal force) at a number of different locations along the periphery of the conveyor. This includes the discrete (still unconnected) components of articles which are about to be formed (e.g., by draping an adhesive-coated uniting band around two or more coaxial rod-shaped components) as well as finished articles which advance beyond the processing or assembling station. The thus released articles can contaminate the machine, especially if they descend onto or are otherwise propelled against moving parts which are likely to break, shred and/or otherwise comminute the articles and their components. The articles, their components and the broken-up parts of the articles and/or components clog the passages between successive conveyors and are likely to cause lengthy and extremely costly interruptions of operation of the entire machine.

Another drawback of heretofore known proposals to remove rod-shaped articles of the tobacco processing industry and/or their components from a particular conveyor in a filter tipping or like machine is that the timing of the start and termination of the interval during which the articles are removed cannot be controlled with a desired degree of accuracy. This entails additional losses during the initial stage of removal of articles and/or components as well as when the removal of a given or approximate number of articles and/or components is being completed. The intervals of time which are available for establishing and terminating the connection between a suction generating device and the suction ports of a drum-shaped conveyor in a modern filter tipping machine are extremely short so that it is very difficult to predictably start and/or terminate the separation of rod-shaped articles and/or their components from the conveyor. Improper timing of the start and/or termination of evacuation of air from the suction ports can give rise to additional disturbances, particularly to accumulations of loose articles and/or their components on as well as in the general area of the conveyor.

OBJECTS AND SUMMARY OF THE INVENTION

An object of the invention is to provide a novel and improved method of separating rod-shaped articles of the tobacco processing industry and/or their components from a conveyor, e.g., from the peripheral surface of a rotary drum-shaped conveyor, in such a way that the start and/or termination of separation can be determined and repeated with a higher degree of accuracy and predictability than in accordance with heretofore known proposals.

Another object of the invention is to provide a method which renders it possible to eliminate undesirable accumulations of loose articles in the machine wherein the articles are conveyed and manipulated, e.g., in a filter tipping machine.

A further object of the invention is to provide a method which renders it possible to remove each of a shorter or longer series of articles and/or their components at a predetermined location and in a predetermined orientation so that all of the separated or removed articles and their components can be gathered automatically and cannot clog and/or otherwise contaminate and/or interfere with orderly operation of the machine.

An additional object of the invention is to provide a novel and improved method of removing rod-shaped articles and/or their components from a rotating drum whereon the articles and/or their components are held by suction, and to separate the articles in such a way that the suction ports of the conveyor need not be sealed from the suction generating device.

Still another object of the invention is to provide a method which can be practiced in existing machines for the processing of rod-shaped articles of the tobacco processing industry with minimal alterations of such machines.

A further object of the invention is to provide a method which ensures that related components of rod-shaped articles are removed, separated or expelled as a unit even if they are not connected to each other at the time they reach the separating or expelling station.

Another object of the invention is to provide a novel and improved apparatus for the practice of the above outlined method and to construct and assemble the apparatus in such a way that it can be readily installed in existing filter tipping and like machines and can employ one or more parts of such machines.

An additional object of the invention is to provide the apparatus with novel and improved means for ensuring predictable removal of selected numbers of rod-shaped articles and/or their components in automatic response to detection of undesirable accumulations of articles and/or components in a filter tipping or other tobacco processing machine.

A further object of the invention is to provide the apparatus with novel and improved means for ensuring that the once segregated articles and/or their components cannot reenter their normal paths and are thus prevented from reaching the destination of articles and/or components which are permitted or caused to remain in their prescribed paths.

Another object of the invention is to provide a tobacco processing machine which embodies the above outlined apparatus.

An additional object of the invention is to provide a production line which embodies the above outlined apparatus.

A further object of the invention is to provide novel and improved means for synchronizing the operation of the above outlined apparatus with the operation of other apparatus or units in a filter tipping or like machine.

One feature of the invention resides in the provision of a method of separating articles of the tobacco processing industry from a surface on which the articles are supported at a series of neighboring locations while the surface advances in a predetermined direction along a predetermined path. The method comprises the steps of rolling the articles along the surface away from the respective locations (in or counter to the predetermined direction) and toward the neighboring locations, and thereafter effecting a movement of the articles away from the surface before the articles reach the neighboring locations. The locations are preferably equidistant from each other, as considered in the predetermined direction.

Each article can comprise several components, and the rolling step preferably includes at least partially uniting the components of the articles so that the thus united components leave the surface as a unit e.g., under the action of gravity, under the action of centrifugal force and/or under the action of a mechanical, pneumatic or other suitable segregating device in the form of an arm, lever, nozzle or the like. Each article can comprise at least one rod-like component and an adhesive-coated sheet-like component which is at least partially rolled around the respective rod-like component in the course of the rolling step. The movement of articles away from the predetermined path is preferably effected in a predetermined portion of such path, and the method can further comprise the steps of interrupting the rolling step so that the components of successive articles advance beyond the predetermined portion of the path, and draping the sheet-like components all the way around the respective rod-like components downstream of the predetermined portion of the path, as considered in the predetermined direction. The draping step can include rolling the sheet-like components of the articles along the surface and around the respective rod-like components.

The path is or can be an arcuate path, and the surface is or can be a cylindrical surface (e.g., the external surface of a drum-shaped conveyor.

The method can further comprise the step of pneumatically holding the articles at the respective locations ahead of the predetermined portion of the path. To this end, the surface can be provided with flutes which determine or define the aforementioned locations, and the holding step then preferably includes attracting the articles to the flutes by suction.

Another feature of the invention resides in the provision of an apparatus for manipulating articles of the tobacco processing industry, particularly components of filter cigarettes and like rod-shaped articles. The apparatus comprises a conveyor having a surface for supporting articles at a series of neighboring locations and means for advancing the surface in a predetermined direction along a predetermined path, a transfer drum or other suitable means for supplying articles to successive locations of the series in a first portion of the path, and means for rolling the articles along the supporting surface away from successive locations of the series of locations in a second portion of the path downstream of the first portion, as considered in the predetermined direction, so that the rolled articles advance toward but short of the neighboring locations and are no longer supported by the surface of the conveyor. The thus released articles can move away from the supporting surface under the action of gravity, under the action of centrifugal force and/or under the action of pneumatic, mechanical and/or other suitable separating or segregating means.

The aforementioned locations on the supporting surface are preferably equidistant from each other, as considered in the predetermined direction, and the rolling means can comprise a block-shaped or otherwise configurated rolling member having a second surface which is spaced apart from the supporting surface but is sufficiently close to the articles in the second portion of the path to cause the oncoming articles to roll along the supporting surface and away from the respective locations. The length of the second surface, as considered in the predetermined direction, is such that the article which has been rolled between the supporting surface and the second surface advances beyond the second surface before it reaches the respective neighboring location.

The apparatus further comprises means for deactivating the rolling means so that the articles remain at the respective locations and advance beyond the second portion of the path. The apparatus also comprises means for processing successive articles in a third portion of the path downstream of the second portion.

The articles can be of the type having at least one rod-like component (e.g., one or two plain cigarettes and a coaxial filter plug) and an adhesive-coated component. The processing means can comprise a device which rolls the rod-shaped components along the supporting surface of the conveyor so as to drape the respective sheet-like components around the rod-like components.

The conveyor can include a hollow rotary drum having a peripheral surface which constitutes the aforementioned supporting surface. The deactivating means can comprise means for moving the rolling means with reference to the conveyor between an operative position nearer to and an inoperative position at a greater distance from the peripheral surface of the drum. Such apparatus preferably further comprises cleaning means (e.g., a rotary cylindrical, frustoconical or analogous brush) which is activatable to remove impurities from the supporting surface downstream of the second portion of the path in the operative position of the rolling means. The cleaning means can include means for simultaneously removing impurities from the supporting surface and from the processing means. Such apparatus can further comprise means for activating the cleaning means in response to movement of rolling means to the operative position and for deactivating the cleaning means in response to movement of the rolling means to its inoperative position.

The peripheral surface of the drum (i.e., the supporting surface of the conveyor) can be provided with article-receiving flutes which define the aforementioned locations and preferably extend substantially transversely of the predetermined direction. Such flutes are preferably equidistant from each other, as considered in the predetermined direction, and the conveyor is or can be provided with suction ports which communicate with the flutes to attract the articles at the respective locations. Such apparatus can further comprise means for throttling the flow of air through the ports which advance along the second portion of the path so as to reduce the likelihood of accidental retention of articles at the respective locations and/or renewed attraction of rolled articles to the supporting surface. As mentioned above, the conveyor can include a hollow drum which is further formed with an internal surface, and each port then extends between the peripheral surface and the internal surface of the drum. The throttling means can include a stationary block-shaped flow restrictor which is adjacent to the internal surface of the drum in the region of the second portion of the path.

The drum is preferably rotatable about a substantially horizontal axis, and the rolling means is preferably adjacent to the supporting surface substantially at the three o'clock position (i.e., at the nine o'clock position, as considered from the other axial end of the drum). The drum is arranged to rotate in a direction to move the articles from a higher level (two o'clock position) to a lower lever (four o'clock position) during transport along the second portion of the path. The rolling means can be provided with the aforementioned second surface which is contacted by successive articles in the second portion of the path and extends substantially tangentially of (or in substantial parallelism with) the supporting surface.

The advancing means is preferably arranged to move the locations along the second portion of the path at one or more predetermined speeds, and the moving means for the rolling means preferably comprises means for moving the rolling means toward or away from the peripheral surface of the rotating drum when an oncoming location is disposed at a predetermined distance from the second portion of the path. This ensures that the operation of the moving means is synchronized with the operation of the drive for the conveyor, i.e., that the rolling means is caused to assume its operative position while an article is on its way toward the second portion of the path and that the rolling means can leave the operative position at the time an article has advanced beyond the second surface and before the next-following article has reached the second surface. Such synchronization of movements of the rolling means between its operative and inoperative position with the timing of arrival of locations into the second portion of the path reduces the likelihood of squashing certain articles and/or an accumulation of articles on the conveyor on their way toward the aforementioned processing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
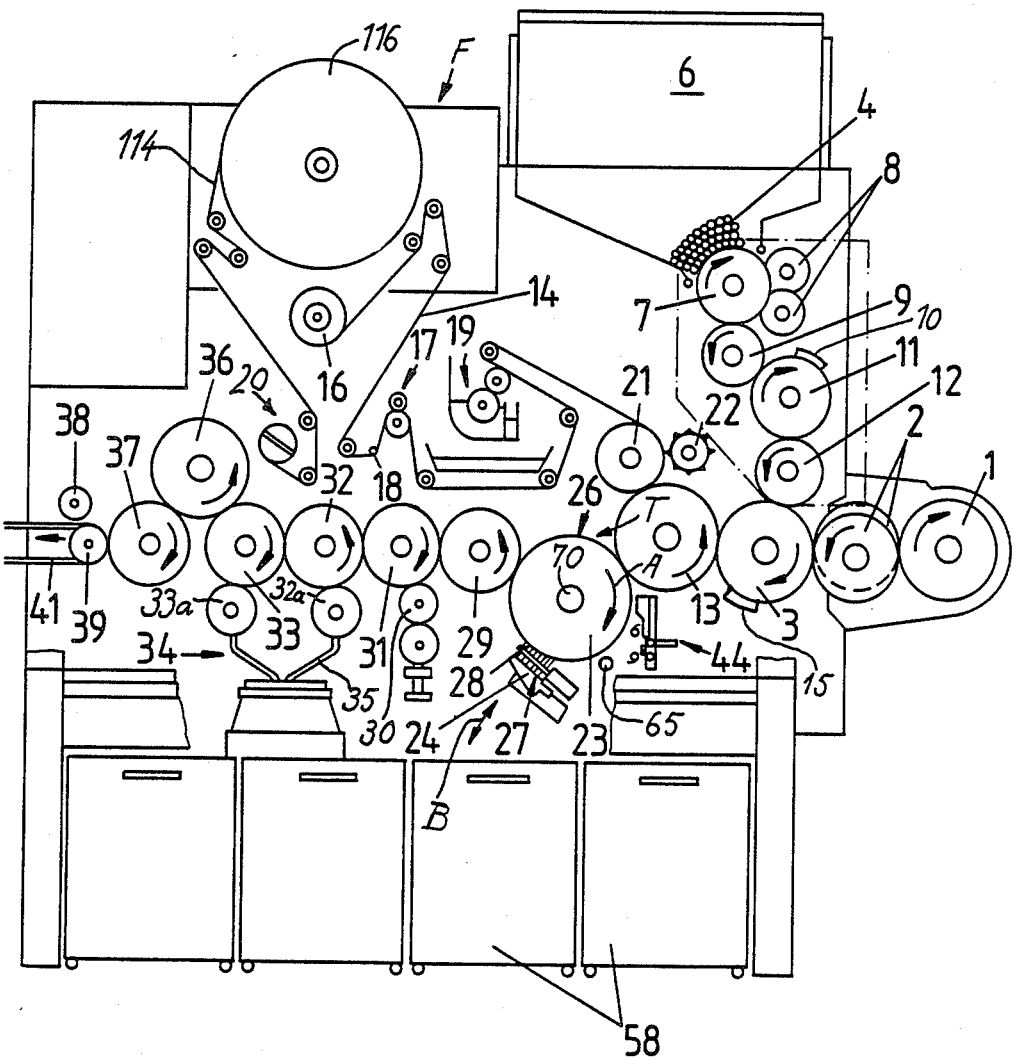
FIG. 1 is a front elevational view of a filter tipping machine embodying an apparatus which is constructed and assembled in accordance with the present invention.

FIG. 1 shows a filter tipping machine of the type known as MAX S which receives two rows of parallel plain cigarettes from a cigarette maker, e.g., a machine known as PROTOS which is made and sold by the assignee of the present application. The maker delivers such rows of plain cigarettes into the axially parallel peripheral flutes of a drum-shaped conveyor 1 whereon the plain cigarettes of one row are staggered with reference to the plain cigarettes of the other row. Successive foremost plain cigarettes of the two rows are accepted by the peripheral flutes of two rotary drum-shaped aligning conveyors 2 which are driven at different speeds and/or accept cigarettes at different transfer stations so that they deliver pairs of coaxial but axially spaced-apart plain cigarettes into successive axially parallel peripheral flutes of a drum-shaped assembly conveyor 3. The directions in which the conveyors advance the rod-shaped components thereon are indicated by arrows.

The frame F of the filter tipping machine supports a magazine 6 for a supply of filter rod sections 4 of six times unit length. The outlet of the magazine 6 discharges filter rod sections 4 into the peripheral flutes of a rotary drum-shaped severing conveyor 7 which cooperates with two circumferentially and axially staggered rotary disc-shaped knives 8 to subdivide each section 4 into a row which contains three coaxial filter plugs of double unit length. The filter plugs of each row are transferred onto three discrete drum-shaped staggering conveyors 9 (only one shown in FIG. 1) which are driven at different speeds and/or receive and/or deliver the respective plugs at different transfer stations so that they admit the thus staggered plugs into discrete axially parallel peripheral flutes of a rotary drum-shaped shuffling conveyor 11 cooperating with one or more cams 10 to shift certain plugs axially and to form a single row of parallel plugs which are located one behind the other and are admitted seriatim into successive axially parallel peripheral flutes of a rotary drum-shaped accelerating conveyor 12. The latter inserts successive filter plugs into successive flutes of the assembly conveyor 3 so that each such flute contains a group 42 (see FIG. 2) of three coaxial rod-shaped components (two plain cigarettes and a filter plug of double unit length between them) which advance between two condensing cams 15 so as to eliminate the clearances between neighboring components of a group 42 before such groups are transferred into the axially parallel peripheral flutes of a rotary drum-shaped transfer conveyor 13.

Figure 2:
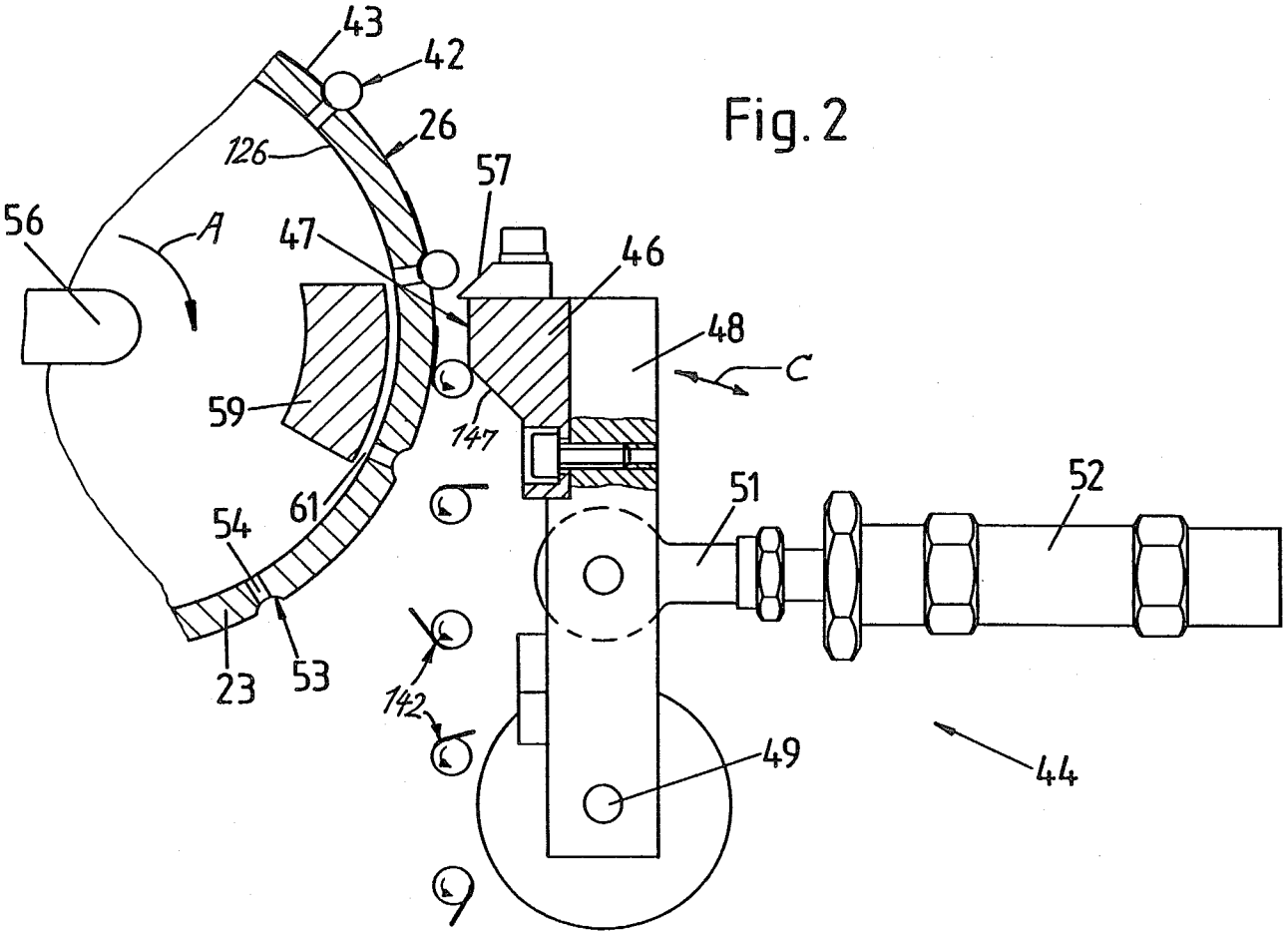
FIG. 2 is a greatly enlarged view of the apparatus, with a portion of the conveyor broken away and with certain parts shown in a vertical sectional view.

The frame F supports the spindle for a reel 16 which discharges a running web 14 of tipping paper toward a curling device 18 of the type disclosed in commonly owned U.S. Pat. No. 3,962,957 to Hinzmann. The web 14 is drawn off the reel 16 by a pair driven advancing rolls 17 and successive increments of the web advance through a paster 19 wherein one side of the web is coated with a suitable adhesive on its way toward a rotary drum-shaped suction drum 21 on which the web 14 is severed at regular intervals by the knives of a rotary drum-shaped cutter 22 to yield a succession of discrete uniting bands 43 (see FIG. 2). The peripheral speed of the suction drum 21 can slightly exceed the speed of the web 14 so that the freshly formed uniting bands 43 are spaced apart from one another prior to being attached to the oncoming groups 42 on the transfer conveyor 13. Each uniting band 43 extends substantially tangentially of the respective group 42 and advances with the latter toward a transfer station T for admission into the oncoming flutes 53 in the peripheral supporting surface 26 of a hollow drum-shaped conveyor 23 the details of which are shown in FIG. 2 and which forms part of the improved article segregating apparatus. The conveyor 23 advances successive groups 42 and the corresponding uniting bands 43 in such a way that the uncoated sides of the uniting bands are adjacent to the supporting surface 26 (see the upper left-hand portion of FIG. 1) on their way toward the gap between such supporting surface and a block-shaped draping or rolling-over member 24 which is pivotable or otherwise movable toward and away from the supporting surface downstream of the transfer station T between the conveyors 13 and 23 (as considered in the direction of rotation of the conveyor 23 (arrow A in FIGS. 1 and 2). The draping member can be said to constitute a means for processing the groups 42 and the respective uniting bands 43 so as to convert such components into filter cigarettes of double unit length.

The draping member 24 is heated in a manner which is well known in the art to promote the setting of adhesive at one side of the uniting band 43 which is convoluted around the respective group 42 while such group rolls between the supporting surface 26 and the adjacent surface of the member 24. Each group 42 completes at least one full revolution about its own axis during travel through the gap between the conveyor 23 and the draping member 24. This ensures that each uniting band 43 is converted into a tube which surrounds the entire filter plug as well as the adjacent inner end portions of the corresponding plain cigarettes.

The filter tipping machine further comprises a cleaning device 27 which is activatable to remove impurities (particularly to remove remnants of adhesive paste) from the supporting surface 26 of the conveyor 23 as well as from the adjacent surface of the draping member 24. The draping member 24 is pivotable or otherwise movable between an operative position in which it is nearer to the supporting surface 26 and the inoperative position of FIG. 1 in which the cleaning device 27 (e.g., a device having a rotary cylindrical brush 28) can enter the space between the surface 26 and the member 24 to travel from one axial end toward the other axial end of the conveyor 23 (either once or more than once) and to thereby scrape or sweep away the impurities (including dust, dried adhesive, fragments of rod-shaped components of the groups 42 and/or fragments of uniting bands 43) before the operation at the draping station is resumed upon return movement of the draping member 24 to its operative position. The directions in which the draping member 24 is movable between the inoperative position of FIG. 1 and its operative position are indicated by a double-headed arrow B. The means for vibrating, rotating or otherwise moving the brush 28 of the cleaning device 27 in the course of a cleaning operation, and the means for moving the cleaning device in parallelism with the axis of the conveyor 23, are not specifically shown in the drawing. Details of a cleaning device which can be used in the filter tipping machine of FIG. 1 are fully disclosed in German Offenlegungsschrift No. 2 842 834 which is owned by the assignee. This printed publication further discloses means for initiating the movement of a draping member to its operative position in response to completion of a cleaning operation, as well as means for starting the cleaning operation in response to completion of movement of the draping member to its inoperative position. The cleaning device 27 is or can be mounted for pivotal movement to and from a position in which it is ready to vibrate or rotate its brush 28 and to simultaneously move in parallelism with the axis of the conveyor 23 in order to simultaneously sweep, scrub and/or otherwise treat successive increments of the supporting surface 26 on the rotating conveyor 23 as well as successive increments of the rolling surface on the draping member 24.

The finished articles which advance beyond the gap between the conveyor 23 and the draping member 24 (when the latter is held in its operative position) are filter cigarettes of double unit length which leave the conveyor 23 at a station between such conveyor and a rotary drum-shaped drying conveyor 29 whose flutes carry the finished articles toward and deliver them into the axially parallel peripheral flutes of a rotary drum-shaped severing conveyor 31 cooperating with a disc-shaped knife 30 to cut successive articles midway across the converted (tubular) uniting band and to thus convert each filter cigarette of double unit length into a pair of filter cigarettes of unit length. The filter mouthpieces of each pair of filter cigarettes of unit length are adjacent to each other; therefore, and in order to reduce the number of testing units, one filter cigarette of each pair must be turned end-for-end and all filter cigarettes of unit length must be assembled into a single row. This takes place in a turn-around device 34 of the type disclosed in commonly owned U.S. Pat. No. 3,583,546 to Koop. One filter cigarette of each pair advances, without inversion, in a flute of a first rotary-drum-shaped conveyor 32 and thereupon in a flute of a second rotary drum-shaped conveyor 33 of the turn-around device 34 on its way toward an axially parallel peripheral flute of a rotary drum-shaped testing conveyor 36. The conveyor 32 also receives the second filter cigarette of each pair but delivers such second cigarette to a flute of a further drum-shaped conveyor **32*a* cooperating with orbiting arms 35 of the turn-around device 34. The arms 35 transport the respective filter cigarettes of unit length along an arcuate path with attendant inversion through 180 degrees and deposit the inverted filter cigarettes into the flutes of a further drum-shaped conveyor 33*a* in the device 34. The conveyor 33*a* delivers the inverted filter cigarettes into empty flutes between the non-inverted filter cigarettes on the conveyor 33 so that all filter cigarettes of unit length form a single row whose articles are transferred into successive flutes of the testing conveyor 36**.

The heating conveyor 29 or the severing conveyor 31 can also constitute a means for testing rod-shaped articles (filter cigarettes of double unit length) by permitting all incomplete articles (lacking one or more components) to descend by gravity so that they cannot reach the conveyor 32 of the turn-around device 34. The conveyor 36 cooperates with means for monitoring one or more characteristics of successive filter cigarettes of unit length, e.g., their length, their density, their filling power, the integrity of their wrappers, the density of their ends and/or others. Defective articles are segregated from satisfactory articles on an ejecting conveyor 37 which delivers satisfactory articles onto the upper reach of an endless belt conveyor 41 serving to advance the satisfactory articles to storage, to a packing machine or to another destination. The arrangement may be such that the articles on the conveyor 36 are tested for the condition of their wrappers and the articles on the conveyor 37 are tested for the density of their heads whereby the conveyor 37 cooperates with means (e.g., one or more nozzles which discharge blasts of compressed air) for segregating the articles which have been found to be unacceptable during travel with the conveyor 36 as well as the articles which have been found to be unacceptable during travel with the conveyor 37.

The belt conveyor 41 is trained over several pulleys 39 (only one shown) and cooperates with a braking roll 38.

The frame F of the filter tipping machine further supports a spindle for a fresh reel 116 of tipping paper and a splicing device 20 which is started when the supply of tipping paper on the reel 16 is nearly exhausted to attach the leader of the fresh web 114 to the trailing end portion of the expiring web 14. Details of a splicing device which can be used in the machine of FIG. 1 are disclosed, for example, in the commonly owned U.S. Pat. No. 3,730,811 to Wendt.

The separating or segregating station 44 where the components 42, 43 of successive articles (filter cigarettes of double unit length) can be separated from the supporting surface 26 of the conveyor 23 is located upstream of the station for the draping member 24 (as considered in the direction of arrow A) and downstream of the transfer station T where the conveyor 13 supplies groups 42 and partially attached uniting bands 43 to successive axially parallel equidistant peripheral flutes 53 in the supporting surface 26. Each such flute defines a predetermined location for retention of a group 42 and of the associated uniting band 43 on the supporting surface 26 during travel from the transfer station T toward the draping member 24. The separating station 44 is located at the three o'clock position of the hollow drum-shaped conveyor 23 (as viewed in FIG. 1 or 2) and accommodates a block-shaped rolling device 46 mounted at the free upper end of a lever 48 which is fulcrumed in the frame F, as at 49, so that it can be pivoted in directions indicated by the double-headed arrow C between the operative position of FIG. 1 or 2 and an inoperative position. The rolling device 46 has a relatively short rolling surface 47 which extends substantially tangentially of the adjacent portion of the supporting surface 26 and can be moved sufficiently close to the conveyor 23 (see FIG. 2) to set the oncoming group 42 in rolling motion and to thereby dislodge such group from the respective flute 53. The length of the rolling surface 47 is such that the dislodged group 42 can travel toward but cannot actually reach the neighboring flute 53 (i.e., a flute nearest to the flute from which the group 42 was dislodged by a projection 57 at the upstream end of the rolling surface 47, as considered counter to the direction of arrow A). The means for moving the lever 48 (and hence the rolling member 46) toward and away from the supporting surface 26 and for deactivating the rolling device 46 (when necessary) includes a fluid-operated (e.g., pneumatic) double-acting cylinder and piston unit 52 whose piston rod 51 is articulately connected to an intermediate portion of the lever 48.

When the filter tipping machine operates normally, the lever 48 maintains the rolling device 46 in the inoperative position so that the groups 42 and the uniting bands 43 can bypass the projection 57 on their way from a first portion (transfer station T) of their arcuate path toward and past the second portion (separating station 44) and on toward the third portion (the gap between the supporting surface 26 and the draping member 24 which latter is then held in operative position in order to drape the uniting bands 43 of successive articles around the respective groups 42.

The flutes 53 in the supporting surface 26 of the conveyor 23 communicate with suction ports 54 which extend all the way to the internal surface 126 of the conveyor 23 and communicate with the intake of a suction generating device 56. The intake of the device 56 is preferably located axially of the conveyor 23 and the cylindrical wall of this conveyor is provided with additional suction ports (not shown in FIG. 2) which serve to attract the uniting bands 43 on their way from the station T toward the draping member 24. Reference may be had to commonly owned U.S. Pat. No. 4,445,519 to Hinz. The flutes 53 are equidistant from each other, as considered in the direction of the arrow A, and are parallel to the axis of the conveyor 23.

When the supporting surface 26 and/or the surface of the draping member 24 is contaminated, e.g., by depositions of adhesive paste thereon, the cleaning device 27 must be activated to remove such impurities while the draping member 24 is held in the inoperative or retracted position of FIG. 1. This means that the conversion of groups 42 and corresponding uniting bands 43 into filter cigarettes of double unit length must be interrupted and, in order to avoid continued delivery of groups 42 and uniting bands 43 toward the combined draping and cleaning station, the rolling device 47 at the separating station 44 must be activated by pivoting the device 46 to the operative position of FIG. 2 simultaneously with or shortly prior to movement of the draping member 24 to the inoperative position of FIG. 1. The cleaning device 27 can be activated (i.e., the rolling device 46 can be deactivated) at regular intervals or when the need arises. Reference may be had to the disclosure of the aforementioned commonly owned German Offenlegungsschrift No. 2 842 834. Thus, the draping station can accommodate a detector 65 which generates a signal serving to start the moving means 52 so as to pivot the lever 48 to the positon of FIG. 2 and to retract the draping member 24 to the position of FIG. 1. Also, such signal can initiate the movement of the brush 28 of the cleaning device 27 into the gap between the supporting surface 26 and the surface of the retracted draping member 24 as well as a rotation of the brush 28 so that the surfaces of the conveyor 23 and draping member 24 undergo a thorough cleaning action. The arrangement is preferably such that the movements of the lever 48 to and from the position of FIG. 2 are properly synchronized with the advancement of successive flutes 53 toward the separating station 44 so as to ensure that the projection 57 is placed into the path of movement of the foremost oncoming group 42 which is thereby reliably expelled from the respective flute 53 but is prevented from entering, the next-following (trailing) flute 53. In addition, the surface 47 of the rolling device 46 cooperates with the adjacent portions of the moving supporting surface 26 to at least partially roll successive uniting bands 43 around the respective groups 42 so that all components of a filter cigarette to be are separated as a unit and can descend by gravity and under the action of centrifugal force (note the articles 142 in FIG. 2) to enter one or more receptacles 58 (FIG. 1) below the separating station 44.

The structure of FIG. 2 preferably further comprises a stationary throttling device having a block-shaped flow restrictor 59 which is adjacent to the internal surface 126 and defines therewith a narrow channel 61 wherein the pressure is higher than in the major part of the internal space of the conveyor 23. Therefore, the force with which the ports 54 travelling along the convex side of the flow restrictor 59 attract the groups 42 which advance along the second portion of their path (through the separating station 44) is less pronounced than the force with which the other ports 54 attract the respective groups 42. This ensures that the once-released articles 142 cannot return toward and cannot advance with the supporting surface 26 toward the brush 28 which is then in the process of cleaning the surface 26 and the surface of the draping member 24.

When the cleaning operation is completed (e.g., when the rotating brush 28 has completed one or more sweeps from one axial end toward the other axial end of the conveyor 23), the moving means 52 receives a signal (e.g., from a time-delay device) to retract the rolling device 46 to the inoperative position and to return the draping member 24 to its operative position. The brush 28 is returned to its starting position before the draping member 24 is pivoted back toward the supporting surface 26. The apparatus including the drum-shaped conveyor 23 and the draping member 24 is then again in a condition to convert successive groups 42 and the associated uniting bands 43 into filter cigarettes of double unit length. The return movement of the rolling device 46 to its inoperative position also takes place in synchronism with the movement of flutes 53 toward, past and beyond the separating station 44 so as to ensure that the foremost group 42 which is free to advance toward the draping member 24 is properly received in its flute 53 and can be converted into the cylindrical portion of a satisfactory filter cigarette of double unit length. In other words, the transition from operation with the rolling device 24 (separation of articles 142) to operation with the draping member 24 is smooth, and the same applies for the transition from operation with the draping member 24 to operation with the rolling device 46.

Satisfactory timing of movements of the rolling device 46 and draping member 24 to their operative and inoperative positions can be readily achieved by employing a suitable timing pulse generator such as is disclosed, for example, in U.S. Pat. No. 3,889,240. The disclosure of this patent is incorporated herein by reference. Such timing pulse generators are used in many types of tobacco processing machines. The foremost group 42 which is to be separated from the supporting surface 26 invariably strikes against the projection 57 on the lever 48 when it reaches the separating station 44, and the last group 42 which is to be separated is free to roll along the entire surface 47 of the rolling device 44 before the latter is pivoted to its inoperative position. The group 42 which follows the last-separated group 42 is not permitted to touch the projection 57 and/or to roll along the surface 47. Such timing of movements of the rolling device 46 to and from its operative position reduces the likelihood of a pileup of unsatisfactory groups 42 and corresponding uniting bands 43 at the draping station.

The conveyor of the filter tipping machine is driven by a main prime mover, not shown. Reference may be had to U.S. Pat. No. 4,368,743 to Barbe et al. The means for directly driving the conveyor 23 comprises a horizontal shaft 70.

As mentioned above, the moving means 52 can be actuated at regular intervals or when the need arises (note the detector 65). Cleaning of the supporting surface 26, particularly jointly with a cleaning of the surface of the draping member 24, at regular intervals is often preferred because this forestalls serious disturbances and lengthy interruptions of operation. The person in charge knows the approximate intervals of time during which the accumulations of adhesive on the surface 26 and/or on the rolling surface of the draping member 24 are sufficiently pronounced to warrant removal of such accumulations by the brush 28.

The surface 147 of the rolling device 46 (immediately downstream of the surface 47) can be said to constitute a means for effecting separation of partially finished articles 142 from the supporting surface 26 of the conveyor 23 because the surface 147 allows the articles 142 to leave the surface 26 under the action of gravity and/or centrifugal force. A paddle wheel, one or more nozzles which discharge compressed air, or other suitable means can be provided in the region of the surface 147 to further reduce the likelihood that the articles 142 would continue to travel with the surface 26 downstream of the surface 147.

An important advantage of the improved method and apparatus is that the articles 142 are caused to leave the surface 26 at an accurately defined station (44) so that they can enter the receptacle or receptacles 58. Moreover, the number of wasted articles is reduced to a minimum because the suction generating device 56 need not be turned off during any stage of operation of the rolling device 46, draping member 24 and/or cleaning device 27, i.e., the apparatus can be operated in such a way that none of the finished articles must be discarded. The segregation of articles 142 is confined to a single station (44) so that the likelihood of clogging of certain parts of the filter tipping machine with uncontrolledly discharged or released rod-shaped articles and/or components of such articles is very remote.

Another important advantage of the improved method and apparatus is that the timing of movements of the rolling device 46 to and from its operative position can be determined with a high degree of accuracy so that the apparatus can control the movements of the first or foremost group 42 and associated uniting band 43 to be removed from the surface 26 as well as the last or rearmost group 42 and associated uniting band 43 which are to enter one of the receptacles 58.

An additional important advantage of the improved method and apparatus is that each group 42 to be separated from the surface 26 is invariably connected with the corresponding uniting band 43 to the extent which is necessary to ensure that such components travel jointly (as shown at 142) toward and into the respective receptacle 58. This reduces the likelihood of contamination of the machine with adhesive-coated uniting bands 43 which would be much less likely to travel in a predetermined direction (upon separation from the surface 26) than the partially assembled articles 142 wherein the uniting bands 43 adhere to the respective rod-shaped components or groups 42 with a force which ensures that the uniting bands 43 become separated from the perforated portions of the surface 26 between the flutes 53.

Last but not least, another important advantage of the improved method and apparatus is that the operation of the filter tipping machine (and of the production line in which the filter tipping machine is installed) need not be interrupted at all while the surface 26 is being cleaned to remove remnants of adhesive or other impurities. This greatly reduces the losses in output because the delivery of filter cigarettes of double unit length to the drying conveyor 29 of FIG. 1 is interrupted only during the interval which is actually needed to complete a cleaning operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of separating articles of the tobacco processing industry from a surface on which the articles are supported at a series of neighboring locations while the surface advances in a predetermined direction along a predetermined path, comprising the steps of rolling the articles along said surface away from the respective locations and toward the neighboring locations, each article comprising at least one rod-shaped component and an adhesive-coated sheet-like component, said rolling step including at least partially uniting the components of the articles so that the thus united components leave said surface as a unit wherein the sheet-like component is at least partially rolled around the respective rod-like component in the course of said rolling step; thereafter effecting a movement of articles away from said surface before the articles reach the neighboring locations, the movement of articles away from said surface being effected in a predetermined portion of said path; interrupting said rolling step so that the components of each article advance beyond the predetermined portion of said path; and draping the the sheet-like components around the respective rod-like components downstream of said predetermined portion, as considered in said direction.

2. The method of claim 1, wherein the neighboring locations of said series are equidistant from each other.

3. The method of claim 1, wherein said draping step includes rolling the sheet-like components of the articles along said surface and around the respective rod-like components.

4. The method of claim 1, wherein said path is an arcuate path.

5. The method of claim 1, wherein said surface is a substantially cylindrical surface.

6. Apparatus for manipulating articles of the tobacco processing industry, particularly components of filter cigarettes and like rod-shaped articles, comprising a conveyor having a surface for supporting articles at a series of neighboring locations and means for advancing said surface in a predetermined direction along a predetermined path; means for supplying articles to successive locations of said series in a first portion of said path; means for rolling the articles along said surface away from successive locations of said series in a second portion of said path downstream of said first portion, as considered in said direction, so that the rolled articles advance toward but short of the neighboring locations and are no longer supported by said surface; means for deactivating said rolling means so that the articles remain at the respective locations and advance beyond the second portion of said path; and means for processing successive articles in a third portion of said path downstream of said second portion.

7. The apparatus of claim 6, wherein said locations are equidistant from each other, as considered in said direction, said rolling means comprising a rolling member having a second surface which is spaced apart from said supporting surface but is sufficiently close to the articles in the second portion of said path to cause the oncoming articles to roll along said supporting surface and away from the respective locations.

8. The apparatus of claim 7, wherein the length of said second surface, as considered in said direction, is such that the article which has been rolled between said surfaces advances beyond said second surface prior to reaching the respective neighboring location.

9. The apparatus of claim 6 for manipulating articles of the type having at least one rod-like component and an adhesive-coated component, wherein said processing means includes a member for rolling the rod-shaped components along said surface so as to drape the respective sheet-like components around such rod-like components.

10. The apparatus of claim 9, wherein said conveyor includes a rotary drum having a peripheral surface which constitutes said supporting surface.

11. The apparatus of claim 9, wherein said deactivating means comprises means for moving said rolling means with reference to said conveyor between an operative position and an inoperative position, and further comprising cleaning means activatable to remove impurities from said supporting surface downstream of the second portion of said path in the operative position of said rolling means.

12. The apparatus of claim 11, wherein said cleaning means includes means for simultaneously removing impurities from said supporting surface and from said processing means.

13. The apparatus of claim 12, further comprising means for activating said cleaning means in response to movement of said rolling means to said operative position and for deactivating said cleaning means in response to movement of said rolling means to said inoperative position.

14. The apparatus of claim 6, wherein said supporting surface has article receiving flutes which define said locations and extend substantially transversely of said direction.

15. The apparatus of claim 14, wherein said flutes are equidistant from one another, as considered in said direction, and said conveyor has suction ports communicating with said flutes to attract the articles at the respective locations.

16. The apparatus of claim 6, wherein said conveyor includes a drum which is rotatable about a substantially horizontal axis and has a peripheral surface constituting said supporting surface, said rolling means being adjacent to said supporting surface substantially at the three o'clock position of said drum and said drum being arranged to rotate in a direction to move the articles from a higher level to a lower level during transport along the second portion of said path.

17. The apparatus of claim 16, wherein said rolling means has a second surface which is contacted by successive articles in the second portion of said path and extends substantially tangentially of said supporting surface.

18. The apparatus of claim 6, further comprising means for moving said rolling means relative to said conveyor.

19. The apparatus of claim 18, wherein said advancing means is arranged to move said locations along the second portion of said path at at least one predetermined speed, said moving means comprisng means for moving the rolling means with reference to said conveyor when an oncoming location is disposed at a predetermined distance from the second portion of said path.

20. A method of separating articles of the tobacco processing industry from a surface on which the articles are supported at a series of neighboring locations while the surface advances in a predetermined direction along a predetermined path, comprising the steps of rolling the articles along said surface away from the respective locations and toward the neighboring locations; thereafter effecting a movement of articles away from said surface in a predetermined portion of said path before the articles reach the neighboring locations; and pneumatically holding the articles at the respective locations ahead of said predetermined portion of said path.

21. The method of claim 20, wherein said surface has flutes which determine said locations and said holding step includes attracting the articles to said flutes by suction.

22. Apparatus for manipulating articles of the tobacco processing industry, particularly components of filter cigarettes and like rod-shaped articles, comprising a conveyor having a surface for supporting articles at a series of neighboring locations and means for advancing said surface in a predetermined direction along a predetermined path, said supporting surface having article receiving flutes which define said locations and extend substantially transversely of said direction, said flutes being equidistant from one another, as considered in said direction, and said conveyor having suction ports communicating with said flutes to attract the articles at the respective locations; means for supplying articles to successive locations of said series in a first portion of said path; means for rolling the articles along said surface away from successive locations of said series in a second portion of said path downstream of said first portion, as considered in said direction, so that the rolled articles advance toward but short of the neighboring locations and are no longer supported by said surface; and means for throttling the flow of air through said ports in the second portion of said path.

23. The apparatus of claim 22, wherein said conveyor includes a hollow drum having a peripheral surface which constitutes said supporting surface, said conveyor further having an internal surface and each of said flutes extending between said peripheral surface and said internal surface, said throttling means including a flow restrictor adjacent to the internal surface of said conveyor in the region of the second portion of said path.

* * * * *